US005654517A

United States Patent [19]

Miyamoto

[11] Patent Number: 5,654,517

[45] Date of Patent: Aug. 5, 1997

[54] AUTOMATIC PERFORMANCE DEVICE HAVING A FUNCTION OF MODIFYING TONE GENERATION TIMING

[75] Inventor: Hiromu Miyamoto, Hamamatsu, Japan

[73] Assignee: Yamaha Corporation, Hamamatsu, Japan

[21] Appl. No.: 396,683

[22] Filed: Mar. 1, 1995

[30] Foreign Application Priority Data

Mar. 4, 1994 [JP] Japan ..... 6-058377

[51] Int. Cl.[6] ..... G10H 1/053; G10H 1/26

[52] U.S. Cl. ..... 84/609; 84/626; 84/649; 84/658

[58] Field of Search ..... 84/609–614, 649–652, 84/615–620, 653–658, 626

[56] References Cited

U.S. PATENT DOCUMENTS

| | | | |
|---|---|---|---|
| 4,622,879 | 11/1986 | Matsubara | 84/609 |
| 4,881,440 | 11/1989 | Kakizaki | 84/609 |
| 5,085,116 | 2/1992 | Nakata et al. | 84/609 |
| 5,233,521 | 8/1993 | Kimpara | 84/609 |
| 5,241,125 | 8/1993 | Miyamoto | 84/609 |
| 5,254,803 | 10/1993 | Terao | 84/609 |

FOREIGN PATENT DOCUMENTS

| | | |
|---|---|---|
| 62-183496 | 8/1987 | Japan . |
| 5-73036 | 3/1993 | Japan . |

*Primary Examiner*—Stanley J. Witkowski
*Attorney, Agent, or Firm*—Loeb & Loeb LLP

[57] ABSTRACT

Automatic performance data are stored by recording into a memory event data and timing data in correspondence to desired performance events. In recording the automatic performance data, predetermined data (for example, velocity data) contained in the event data is used as control information to modify the timing data, and the modified timing data is recorded into the memory. In reproducing the automatic performance data, the event and timing data are read out from the memory, and the performance events are then sequentially reproduced on the basis of the read-out data for effecting automatic performance. Thus, the reproduction timing of each performance event is finely controlled to modify by use of the control information, and this achieves automatic performance rich in expression. The fine control of the reproduction timing of each performance event may be done by, in stead of modifying the timing data during the recording, reading out unmodified timing data from the memory and modifying the read-out timing data on the basis of the control information during the reproduction.

16 Claims, 7 Drawing Sheets

AUTOMATIC PERFORMANCE DEVICE HAVING A FUNCTION OF MODIFYING TONE GENERATION TIMING

BACKGROUND OF THE INVENTION

The present invention relates generally to automatic performance devices such as sequencers or automatic rhythm performance devices, and more particularly to an automatic performance device having a timing modifying function which allows tone generation timing to be easily varied during an automatic performance to thereby impart a variety of musical expressions to the performance.

The prior art automatic performance devices are designed to generate tones at predetermined timing by sequentially reading out performance data that are prestored in order of performance. In contrast, music performance by a human player presents different musical expressions every time even when the performance is made plural times on a same sheet of music, because the player's emotion may considerably change with the progress of the performance or may be substantially affected by the audience' reaction. However, although the prior art automatic performance devices can quite accurately reproduce the recorded performance data every time in much the same way as playing back of records, they can only provide a monotonous performance lacking musical variety due to the fact that they are unable to impart "on-the-spot" emotional expressions as in a live performance.

As one example of a technique for imparting musical variety to an automatic performance, Japanese Patent Laid-open Publication No. SHO 62-183496 discloses providing "fluctuation" by fluctuating tempo clock in a random manner. But, this technique alone still has the problem that it can only impart monotonous and uniform variation to an automatic performance.

Further, there has recently been proposed an automatic performance device which permits a human performance by finely controlling tone generation timing of performance data to vary or stagger, as disclosed in. Japanese Patent Laid-open Publication No. HEI 5-73036. Namely, the tone generating timing of the performance data is controlled to vary during an automatic performance, on the basis of "deviation pattern data" that is prepared for each predetermined performance timing (for example, for each beat or for each clock pulse) and indicating how much the individual tone generation timing should deviate from the predetermined performance timing. However, such a prior art automatic performance device would present a problem that a great number of "deviation pattern data" are required in addition to the performance data. This device is also disadvantageous in that the tone generation timing can only vary as dictated by the deviation pattern data, thus presenting another problem that the tone generation timing varies monotonously in an uniform manner irrespective of what the original performance data may be like.

SUMMARY OF THE INVENTION

It is therefore an object of the present invention to provide an automatic performance device which, with a relatively simple structure, permits an automatic performance that is rich in emotional expression like a live performance with tone generation timing finely varied.

In order to accomplish the above-mentioned object, an automatic performance device in accordance with a first aspect of the present invention comprises a storage section for storing performance data, an event generation section for generating event data in response to a performance event, a timing data providing section responsive to generation of the event data for providing timing data indicative of reproduction timing of the performance event, a timing modification section for modifying the timing data so as to vary said reproduction timing using, as control information, predetermined data contained in said event data generated by said event generation, a recording section for causing the event data generated by said event generation section to be recorded into said storage section along with the timing data modified by said timing modification section, and a reproduction section for reading out the event data and timing data from the storage section so as to reproduce the performance event on the basis of the read-out data.

As conventionally known, automatic performance data are stored by recording into the storage section event data and timing data in correspondence to desired performance events. An automatic performance is carried out by the reproduction section reading out the event data and timing data from the storage section and sequentially reproducing the performance events on the basis of the read-out data. The present invention according to the first aspect is characterized by the provision of the timing modification section, which modifies the timing data using, as control information, predetermined data contained in the event data generated by the event generation section. The recording section records into the storage section the event data along with the timing data thus modified by the timing modification section. In this way, the modified timing data are recorded in the storage section. In reproduction, actual reproduction timing of the individual performance events will be finely controlled to vary with the control information by reading out the modified timing data and setting reproduction timing of the individual performance events. The control information used for this purpose is just predetermined data contained in the event data rather than specially prepared information. That is, in addition to its essential function, the predetermined data contained in the event data is used as the control information for control to modify the timing data. This eliminates the necessity to prepare a special modification pattern such as a "deviation pattern", thus achieving a substantially simplified structure. Further, because the event data varies for each performance event, the control information to modify the timing data varies in an appropriate manner, and hence it is possible to provide an automatic performance that is rich in expression.

According to a second aspect of the present invention, timing data read out from the storage section may be controlled to modify on the basis of the control information during the reproduction of the performance data. To this end, an automatic performance device in accordance with the second aspect of the present invention comprises a storage section for storing performance data, an event generation section for generating event data in response to a performance event, a timing data providing section responsive to generation of the event data for providing timing data indicative of reproduction timing of the performance event, a recording section for causing the event data generated by the event generation section to be recorded into said storage section along with the timing data, as the performance data, a reproduction section for reading out the event data and timing data from the storage section so as to reproduce the performance event on the basis of the read-out data, and a timing modification section for modifying the timing data read out from the storage section, using, as control information, predetermined data contained in the event data generated by the event generation section, the reproduction section reproducing the performance event data on the basis of the event data and the timing data varied by the timing modification section.

As a typical example, the event data contains note data for designating a note of a tone to be performed, and velocity data for controlling the intensity (key depression velocity in the case of a keyboard musical instrument) of the tone. This velocity data may be used as the control information, and in such a case, the reproduction timing can be finely controlled to vary on the basis of the performance touch, i.e., velocity of key operation for each performance event.

Now, the preferred embodiment of the present invention will be described in detail below with reference to the accompanying drawings.

DETAILED DESCRIPTION OF THE PREFERRED EMBODIMENT

Figure 2:
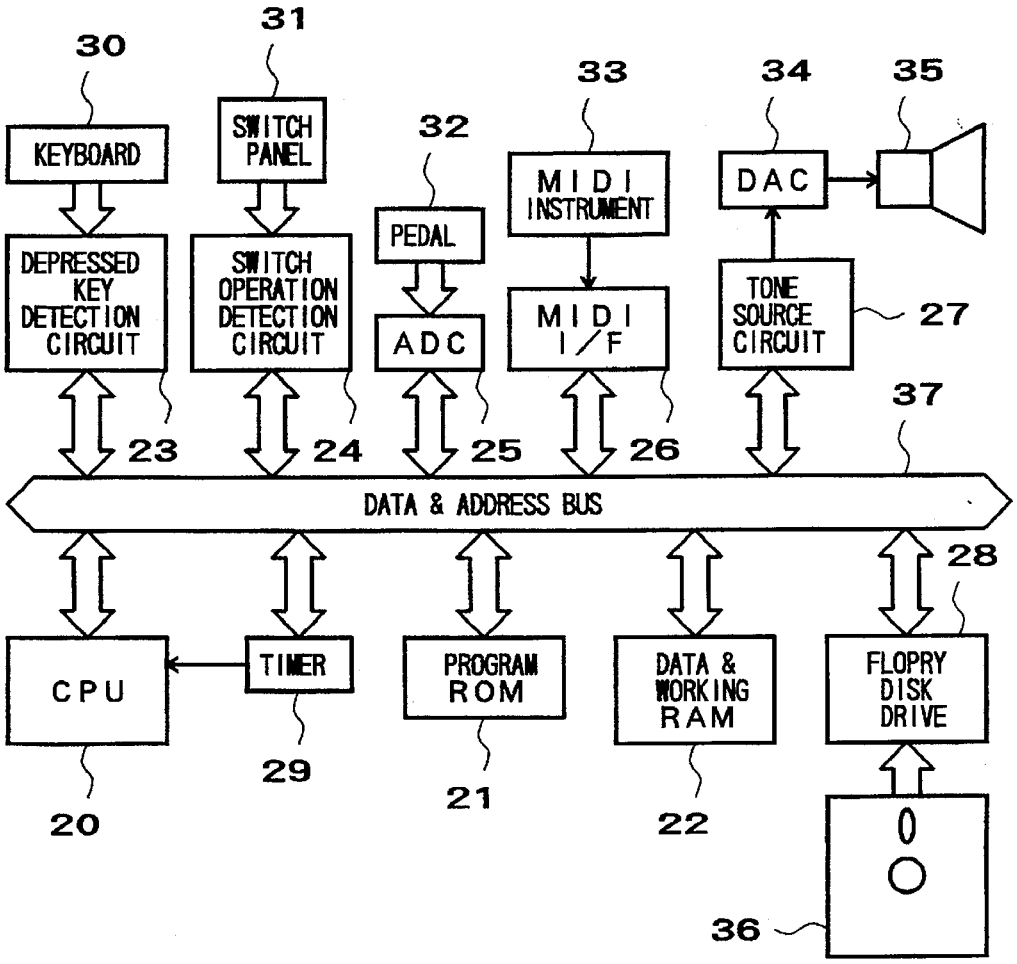
FIG. 2 is a block diagram illustrating the hardware structure of an embodiment of an electronic musical instrument to which is applied the automatic performance device of the present invention.

FIG. 2 is a block diagram illustrating the hardware structure of an embodiment of an electronic musical instrument to which is applied the automatic performance device of the present invention. In this embodiment, various processes are performed under the control of a microcomputer, which comprises a CPU 20, a program ROM 21 and a data and working RAM 22.

For convenience, the embodiment will be described in relation to the electronic musical instrument where the CPU 20 performs a depressed key detection process, an automatic performance process, etc.

The microprocessor unit or CPU 20 controls the entire operation of the electronic musical instrument. To this CPU 20 are connected, via a data and address bus 37, the program ROM 21, data and working RAM 22, depressed key detection circuit 23, switch operation detection circuit 24, analog-to-digital converter 25, MIDI interface 26, tone source circuit 27, floppy disk drive 28 and timer 29.

The program ROM 21 prestores system programs for the CPU 20, automatic performance pattern data, various tone-related parameters and other data.

The data and working RAM 22 temporarily stores various performance data and other data occurring as the CPU 20 executes the programs, and is provided in predetermined address regions of a random access memory (RAM) for use as registers and flags.

A floppy disk 36 stores performance data on a plurality of music pieces and transfers the stored performance data of any desired music piece for performance of the music piece. The floppy disk 36 is driven by the floppy disk drive 28.

A keyboard 30 is provided with a plurality of keys for designating the pitch of each tone to be generated and includes key switches corresponding to the individual keys. If necessary, the keyboard 30 may also include a touch detection means such as a key depressing force detection device. Although described here as including the keyboard 30 that is a fundamental performance operator relatively easy to understand, the embodiment may of course employ any performance operator other than the keyboard.

The depressed key detection circuit 23 includes key switch circuits that are provided in corresponding relations to the pitch designating keys of the keyboard 30. This depressed key detection circuit 23 outputs a key-on event signal upon its detection of a change from the released state to the depressed state of a key, and a key-off event signal upon its detection of a change from the depressed state to the released state of a key. At the same time, the depressed key detection circuit 23 outputs a key code (note number) indicative of the key corresponding to the key-on or key-off event signal. The depressed key detection circuit 23 also determines the depression velocity or force of the depressed key so as to output velocity data and after-touch data.

The switch operation detection circuit 24 is provided, in corresponding relations to operators (switches) provided on a switch panel 31, for outputting, as event information, operation data responsive to the Operational state of the individual operators.

The operators on the switch panel 31 are for selecting, setting and controlling the tone color, volume, pitch, effect etc. of tone to be generated.

A foot pedal 32, which is a kind of operator actuated by the player's foot, is comprised of a movable member and a fixed member and outputs an analog angle signal corresponding to the actuated angle of the movable member.

The analog-to-digital converter 25 converts the analog angle signal output from the foot pedal 32 to a digital pedal signal ranging in value from "0" to "1". This converter 25 outputs a pedal signal of "1" when the stepped-on amount of the foot pedal 32 is the greatest, a pedal signal of "0" when the stepped-on amount is the smallest i.e. when the pedal 32 is not actuated at all, and a pedal signal of any intermediate value between "0" and "1" when the stepped-on amount is intermediate between the greatest and the smallest.

A tone source circuit 27, which is capable of simultaneously generating plural tone signals through a plurality of channels, receives performance data(data conforming to the MIDI standards) supplied via the data and address bus 37 and generates tone signal on the basis of the received performance data.

The tone source circuit 27 may employ any of the conventionally-known tone signal generation systems, such as the memory readout system where tone waveform sample value data prestored in a waveform memory are sequentially read out in response to address data varying in accordance with the pitch of tone to be generated, the FM system where tone waveform sample value data are obtained by performing predetermined frequency modulation using the above-mentioned address data as phase angle parameter data, or the AM system where tone waveform sample value data are obtained by performing predetermined amplitude modulation using the above-mentioned address data as phase angle parameter data.

Each tone signal generated from the tone source circuit 27 is acoustically reproduced or sounded via a digital-to-analog converter 34 and a sound system 35 (comprised of amplifiers and speakers).

A MIDI instrument 33 which produces the MIDI-standards conforming performance data comprises a MIDI keyboard or any other electronic musical instrument. The performance data output from the MIDI instrument 33 are received by the CPU 20 via the MIDI interface 26 and data and address bus 37.

The timer 29 generates tempo clock pulses to be used for counting a time interval and for setting an automatic performance tempo. The frequency of the tempo clock pulses is adjustable by a tempo switch (not shown) provided on the switch panel 31. Each generated tempo clock pulse is given to the CPU 20 as an interrupt command, and the CPU 20 in turn executes various automatic performance processing as timer interrupt processing. In this embodiment, it is assumed the frequency is selected such that 96 tempo clock pulses are generated per quarter note.

Figures 3A, 3B:
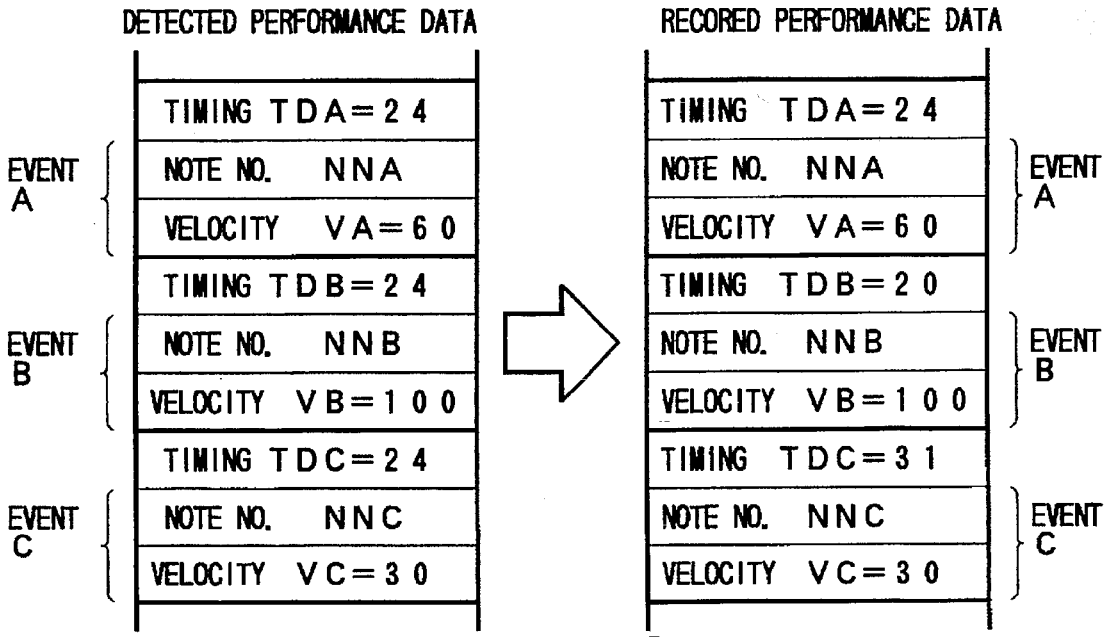
FIG. 3A is a diagram explanatory of example contents of performance data supplied from an external MIDI instrument via MIDI interface and detected by the electronic musical instrument.
FIG. 3B is a diagram explanatory of example contents of performance data recorded on the basis of the data of FIG. 3A.

FIGS. 3A and 3B illustrate how the performance data sent from the external MIDI instrument 33 via the MIDI interface 26 are detected and recorded by the CPU 20 in the device. FIG. 3A shows the arrangement of the performance data having been detected by the CPU 20, while FIG. 3B shows the arrangement of the performance data having been recorded by the CPU 20.

In this embodiment, the respective timing data of the individual events A, B and C are stored in the storage device (RAM 22 or floppy disk 36) after having been variably controlled on the basis of the corresponding velocities.

Since the MIDI instrument 33 produces the performance data in accordance with the so-called "event system", the CPU 20 detects the note number and velocity for each event. Then, on the basis of the tempo clock pulses, the CPU 20 determines the time of each event detection and set timing data based on the determined time. The timing data indicates generation timing of a tone and corresponds to a period of time between time points of the last and current event detection. The note number is data indicative of the pitch of tone to be generated, and the velocity is data indicative of the volume of tone.

For example, when the MIDI instrument 33 produces events A, B and C in the order of mentioning, the CPU 20 sequentially detects event A composed of note number NNA and velocity data VA (=60), event B composed of note number NNB and velocity data VB (=100), and event C composed of note number NNC and velocity data VC (=30). After that, the CPU 20 creates timing data on the basis of the detected time of each event A, B, C. The example of FIG. 3A shows that the tone generation timing of each event A, B, C is "24". Because in this embodiment the duration of a quarter note corresponds to "96" clock pulses as previously mentioned, events A, B and C correspond to a tone generation event of a sixteenth note.

The CPU 20 records the detected performance data (events A, B and C in the example of FIG. 3A) after having variably controlled their corresponding timing data in a recording process as will be described later. Namely, the CPU 20 records the note number NNA, NNB and NNC and velocities VA, VB and VC directly as detected, but records the timing data after having been variably controlled on the basis of the corresponding velocities.

Figure 5:
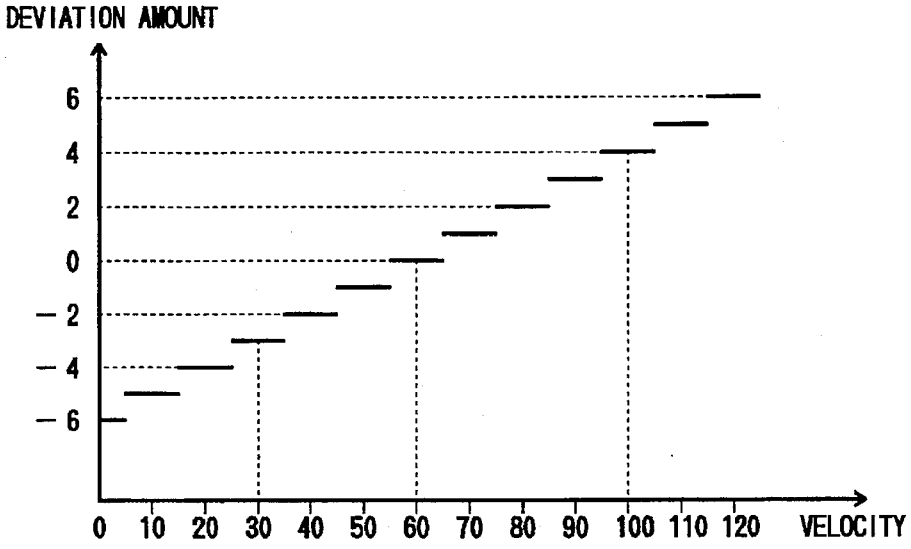
FIG. 5 is a graph showing an example of timing data conversion characteristic employed in the embodiment, in which the horizontal axis represents velocity and the vertical axis represents deviation amount of the timing data.

FIG. 5 is a graph showing an example of timing data conversion characteristic employed in the embodiment, in which the horizontal axis represents velocity and the vertical axis represents deviation amount of the timing data. The conversion characteristic is such that the deviation amount assumes a positive (+) value when the velocity value is greater than a predetermined reference velocity ("60" for instance), but assumes a negative (–) value when the velocity value is smaller than the reference value. In the case of a positive deviation amount, the timing data takes on a value decreased by a value corresponding to this deviation amount so that a tone is generated at timing slightly earlier than predetermined performance timing, thus resulting in a relatively "hasty" or "forward-plunging" performance. Conversely, in the case of a negative deviation amount, the timing data takes on a value increased by a value corresponding to this deviation amount so that a tone is generated at timing slightly later than predetermined performance timing, thus resulting in a relatively "lagging" or "dull" performance.

The conversion characteristic in the example of FIG. 5 is selected such that the deviation amount is "–6" for the velocity range from "1" to "5", "–5" for the velocity range from "6" to "15", "–4" for the velocity range from "16" to "25", "–3" for the velocity range from "26" to "35", "–2" for the velocity range from "36" to "45", "–1" for the velocity range from "46" to "55", "0" for the velocity range from "56" to "65", "+1" for the velocity range from "66" to "75", "+2" for the velocity range from "76" to "85", "+3" for the velocity range from "86" to "95", "+4" for the velocity range from "96" to "105", "+5" for the velocity range from "106" to "115", and "+6" for the velocity range from "116" to "127". It should be appreciated here that the above-mentioned setting of the conversion characteristic is Just illustrative and any other appropriate setting may of course be employed.

For event A of FIG. 3A, since the velocity data VA is 60, the deviation amount is zero according to the conversion characteristic of FIG. 5 and hence the timing data TDA remains at a value of 24. For event B, since the velocity data VA is 100, the deviation amount is +4 and hence the timing data TDB is set to a value of 20 (24–4=20). For event C, since the velocity data VC is 30, the deviation amount is –3 and hence the timing data TDC is set to a value of 31 (24+4+3=31).

Figure 4:
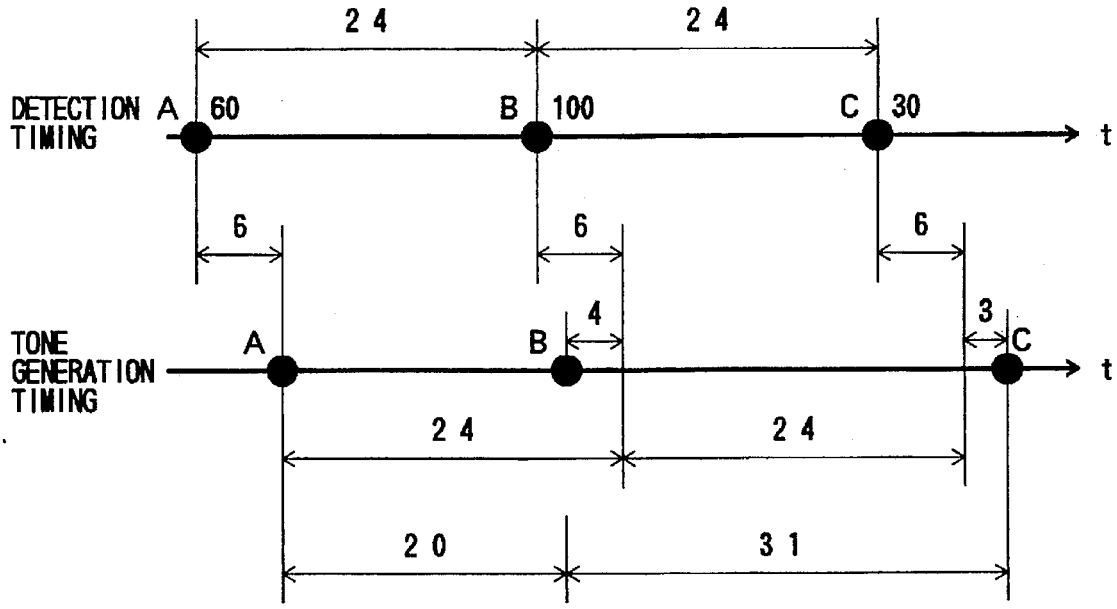
FIG. 4 is a diagram showing a relation between detection timing of the individual event-corresponding performance data of FIGS. 3A and 3B, and tone generation timing of the detected performance data, in which the horizontal axis represents the lapse of time.

FIG. 4 is a diagram showing a relation between detection timing of the performance data corresponding to events A, B and C of FIG. 3, and tone generation timing of the detected performance data, in which the horizontal axis represents the lapse of time t. The detection timing of events A, B and C is shown on the upper portion of FIG. 4, and the tone generation timing of events A, B and C is shown on the lower portion of FIG. 4.

As shown in FIG. 4, the CPU 20 detects event A composed of note number NNA and velocity data VA (=60) and creates timing data TDA (=24) corresponding to a time interval between detection time points of the last event and current event A. At this time, since the CPU 20 obtains a deviation amount "0" based on the velocity data VA (=60), a tone of event A is generated at such timing delayed by a value "6" corresponding to a predetermined time. The value "6" corresponding to the predetermined time is an offset value of tone generation timing which corresponds to a predetermined compensation time that will permit tone generation without causing inconveniences even in a case where the maximum deviation amount of "6" is obtained.

After that, the CPU 20 detects event B composed of note number NNB and velocity data VB (=100) and creates timing data TDB (=24) corresponding to a time interval between detection time points of the last event A and current event B. At this time, since the CPU 20 obtains a deviation amount "+4" based on the velocity data VB (=100), a tone of event B is generated at such timing preceding the above-mentioned offset value "6" by "4".

After that, the CPU 20 detects event C composed of note number NNC and velocity data VC (=30) and creates timing data TDC (=24) corresponding to a time interval between detection time points of the last event B and current event C. At this time, since the CPU 20 obtains a deviation amount "−3" based on the velocity data VB (=30), a tone of event C is generated at such timing further delayed from the above-mentioned offset value "6" by "3".

Now, processing performed by the microcomputer (CPU 20) in the automatic performance device will be described by way of example with reference to the flowchart of FIG. 1, which illustrates an example of a recording process performed by the microcomputer.

When performance data as shown in FIG. 3A are supplied via the MIDI interface 26, this recording process stores the performance data into the data and working RAM or the floppy disk 36 after having determined an interval between time points of the last and current event occurrences so as to create timing data and having controlled the timing data to modify in accordance with the corresponding velocity. The recording process is a timer interrupt process performed, in the following step sequence, at an interrupt rate of 96 times per quarter note.

Step 11: It is determined whether or not any event has been detected. If any event has been detected (YES), the flow proceeds to step 12, but if not, the flow 15 jumps to step 15.

Step 12: According to the conversion characteristic of FIG. 5, a timing modification value (or deviation amount) is determined on the basis of the corresponding velocity.

Step 13: A value obtained by subtracting the timing modification value determined in the preceding step 12 from a predetermined value is stored into a count buffer COUNT. In such a case where a tone is generated concurrently with event detection as shown in FIG. 4. the predetermined value must not be smaller than the maximum value of the positive deviation amounts; in the example of FIG. 4, the predetermined value is the same as the maximum value of deviation amount.

Step 14: Event information and the value stored in the counter buffer COUNT are written into an event buffer. Here, event information is comprised of the note number and velocity data.

Step 15: A determination is made as to whether there is any event in the event buffer for which the count value is "0". If there is such an event in the event buffer (YES), the flow proceeds to step 16, but if not, the flow jumps to step 1A.

Step 16: The value stored in a timing counter TIME is written into the data and working RAM 22 or the floppy disk 36. Namely, this step writes the count value resident in the timing counter TIME at a time point when the preceding step 15 has determined that the count value in the event buffer is "0".

Step 17: The event information (note number and velocity data) in the event buffer is read out and written into the data and working RAM 22 or the floppy disk 36.

Step 18: The event information read out in the preceding step 17 is erased from the event buffer.

Step 19: The timing counter TIME is cleared to "0".

Step 1A: The timing counter TIME is incremented by one.

Step 1B: The count value of every existing event in the event buffer is decremented by one, and the flow returns.

Next, with reference to FIG. 6, a description will be made on an example of the general operation of the device executed according to the flowchart of the recording process of FIG. 1.

Figure 1:
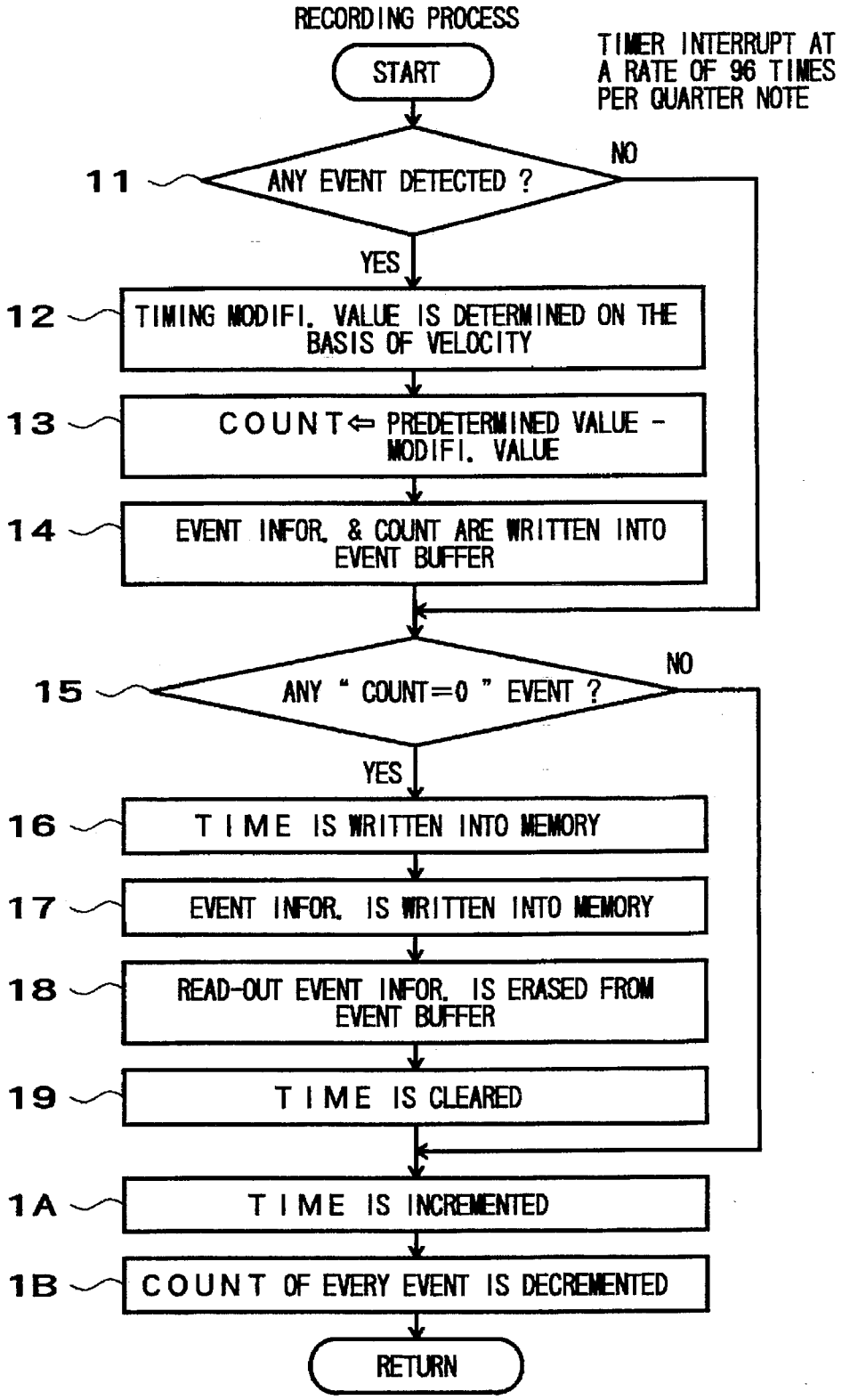
FIG. 1 is a flowchart illustrating an embodiment of a recording process performed by a microcomputer in an automatic performance device of the present invention.
Figure 6:
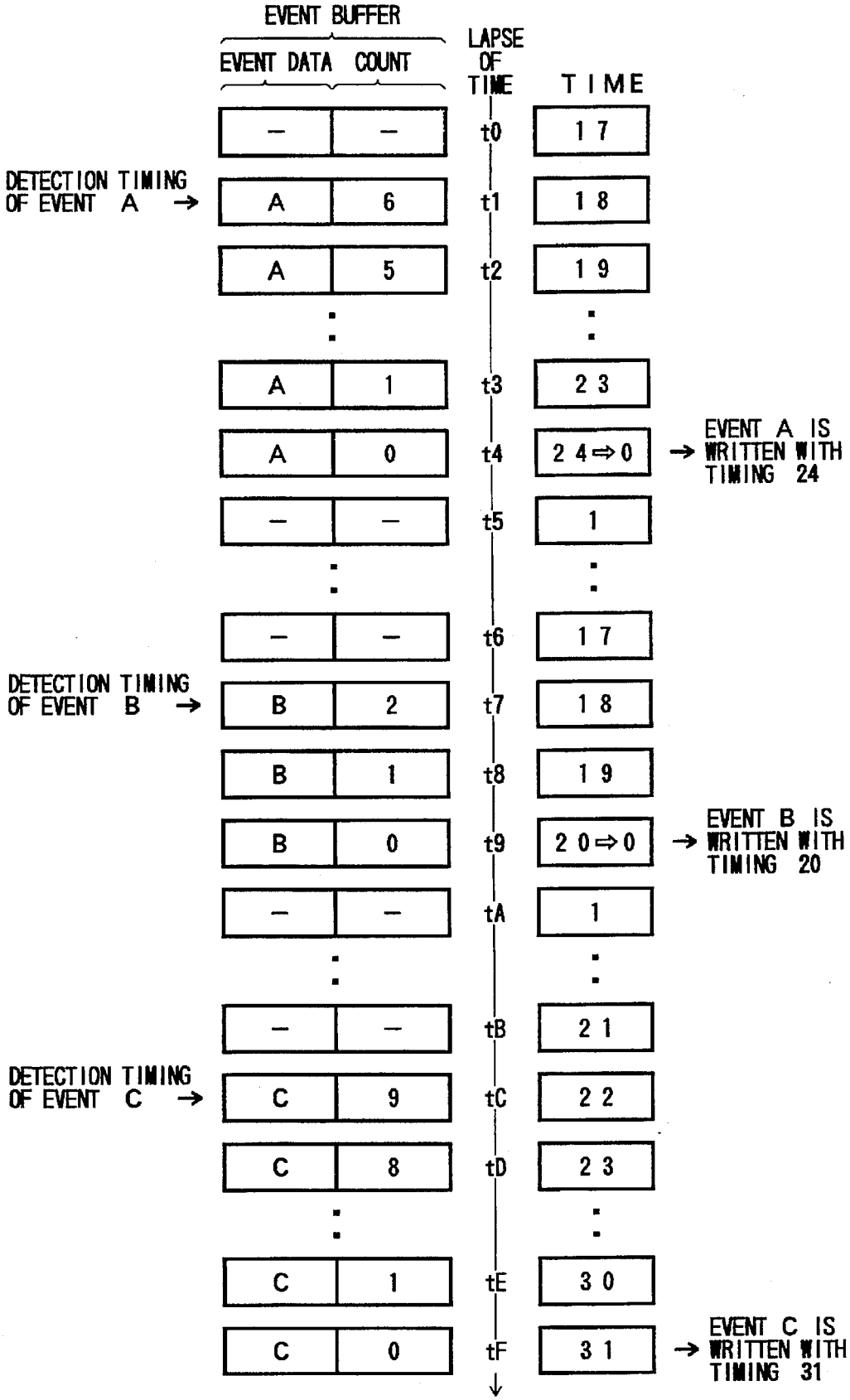
FIG. 6 is a diagram explaining how the contents of an event buffer and a timing counter vary with time when the performance data of FIG. 3A are recorded in a manner as shown in FIG. 3B by the recording process of FIG. 1.

FIG. 6 is a diagram explaining how the contents of the event buffer and timing counter vary with time when the performance data such as those of events A, B and C of FIG. 3A are recorded as shown in FIG. 3B by the recording process of FIG. 1.

At time point t0 of FIG. 6, no event is detected and the event buffer is empty, so that steps 11 and 15 both make a "NO" determination and hence only the operation of step 1A is performed. In step 1A, the timing counter TIME is incremented to "18". But, the operation of step 1B is not performed because the event buffer is empty. It should be understood here that a value "17" shown as stored in the timing counter TIME at time point t0 is just an example and it may be any other value.

At time point t1, event A is detected and hence the determination in step 11 becomes affirmative, so that steps 12 to 14 are performed. In step 12, a modification value "0" is determined on the basis of the velocity data VA (=60) of event A. In step 13, the value "6" obtained by subtracting the modification value "0" from the predetermined value "6" is stored into the count buffer COUNT. In step 14, the event information (note number NNA and velocity data VA (=60)) and the count value "6" in the count buffer COUNT are written into the event buffer.

At this time, because the count value of the event buffer is "6", a "NO" determination is made in step 15, the timing counter TIME is incremented to "19" in step 1A, and the count value in the event buffer becomes "5" in step 1B.

At time point t2, no event is detected with the event buffer being at a count value of "5", and hence steps 11 and 15 both make a negative determination. Then, by the operations of steps 1A and 1B, the timing counter TIME is incremented to "20" and the count value in the event buffer is decremented to "4".

After that, until the count value in the event buffer becomes "0", the incrementing of the timing counter TIME and the decrementing of the event buffer count value are performed repetitively. In this way, the count value in the event buffer becomes "0" at time point t4, upon which the determination in step 15 becomes affirmative and the operations of steps 16 to 1B are performed. In steps 16 and 17, the value "24" in the timing counter TIME and the event information of event A (note number NNA and velocity data VA (=60)) in the event buffer are read out and written into the data and working RAM 22 or the floppy disk 36.

In step 18, the event information read out in the previous step 16 is erased from the event buffer. In step 19, the timing counter TIME is cleared to "0". Further, in step 1A, the timing counter TIME is incremented to "1". But, the operation of step 1B is not performed because no count value is present in the event buffer.

At step t5, because no event is detected and the event buffer is empty, steps 11 and 15 both make a negative determination, and only the operation of step 1A is performed to bring the timing counter TIME to a count value of "2".

Until event B is detected, the incrementing of the timing counter TIME is repetitively performed in the above-mentioned manner. Then, at time point t7, event B is detected, so that the determination of step 11 becomes affirmative and the operations of steps 12 to 14 are performed.

In step 12, a modification value "+4" is determined on the basis of the velocity data VB (=100) of event B. In step 13, the value "2" obtained by subtracting the modification value "+4" from the predetermined value "6" is stored into the count buffer COUNT. In step 14, the event information (note number NNB and velocity data VB (=100)) and the count value "2" in the count buffer COUNT are written into the event buffer.

At this time, because the count value of the event buffer is "2", a "NO" determination is made in step 15, the timing counter TIME is incremented to "19" in step 1A, and the count value in the event buffer becomes "1" in step 1B.

At time point t8, no event is detected with the event buffer being at a count value of "1", and hence steps 11 and 15 both make a negative determination. Then, by the operations of steps 1A and 1B, the timing counter TIME is incremented to "20" and the count value in the event buffer is decremented to "0".

In this way, the count value in the event buffer becomes "0" at time point t9, upon which the determination in step 15 becomes affirmative and the operations of steps 16 to 1B are performed. In steps 16 and 17, the value "20" in the timing counter TIME and the event information of event B (note number NNB and velocity data VB (=100)) in the event buffer are read out and written into the data and working RAM 22 or the floppy disk 36.

In step 18, the event information read out in the previous step 16 is erased from the event buffer. In step 19, the timing counter TIME is cleared to "0". Further, in step 1A, the timing counter TIME is incremented to "1". But, the operation of step 1B is not performed because no count value is present in the event buffer.

At step tA, because no event is detected and the event buffer is empty, steps 11 and 15 both result in a negative determination, and the operation of step 1A is performed to bring the timing counter TIME to a count value of "2".

Until event C is detected, the incrementing of the timing counter TIME is repetitively performed in the above-mentioned manner. Namely, at time point tC when the timing counter TIME is at a count value of "22", event C is detected, so that the determination of step 11 becomes affirmative and hence the operations of steps 12 to 14 are performed.

In step 12, a modification value "−3" is determined on the basis of the velocity data VC (=30) of event C. In step 13, the value "9" obtained by subtracting the modification value "−3" from the predetermined value "6" is stored into the count buffer COUNT. In step 14, the event information (note number NNC and velocity data VC (=30)) and the count value "9" in the count buffer COUNT are written into the event buffer.

At this time, because the count value of the event buffer is "9", a "NO" determination is made in step 15, the timing counter TIME is incremented to "23" in step 1A, and the count value in the event buffer becomes "8" in step 1B.

At time point tD, no event is detected with the event buffer being at a count value of "8", and hence steps 11 and 15 both result in a negative determination, upon which the timing counter TIME becomes "23" and the event buffer comes to a count value of "7".

Then, at time point tF, the count value of the event buffer is "0" and the determination in step 15 becomes affirmative, upon which the operations of steps 16 to 1B are performed. In steps 16 and 17, the value "31" in the timing counter TIME and the event information of event C (note number NNC and velocity data VC (=30)) in the event buffer are read out and written into the data and working RAM 22 or the floppy disk 36.

In step 18, the event information read out in the previous step 16 is erased from the event buffer. In step 19, the timing counter TIME is cleared to "0". Further, in step 1A, the timing counter TIME is incremented to "1". But, the operation of step 1B is not performed because no count value is present in the event buffer.

Then, until event D is detected, the incrementing of the timing counter TIME is repetitively performed in the above-mentioned manner.

In the above-mentioned step sequence, the detected performance data of FIG. 3A are recorded in the manner as shown in FIG. 3B with the timing data modified on the basis of the corresponding velocities.

Next, another example of processing performed by the microcomputer (CPU 20) in the automatic performance device will be described on the basis of a flowchart shown in FIG. 7, which illustrates an example of a reproduction process performed by the microcomputer.

In such a case where the performance data as shown in FIG. 3A are recorded in the data and working RAM or the floppy disk 36, this reproduction process reproduces the performance data after having variably controlled the timing data to modify in accordance with the corresponding velocity values. The reproduction process is a timer interrupt process that is executed, in the following step sequence, at an interrupt rate of 96 times per quarter note.

Step 71: A determination is made as to whether or not the timing counter TIME is at a count value of "0". If so (YES), the flow proceeds to next step 72, but if the counter TIME is other than zero, the flow jumps to step 78.

Step 72: The performance data is read out from the memory (data and working RAM or the floppy disk 36) by incrementing the readout address of the memory.

Step 73: Because the performance data are comprised of timing data, note number and velocity data arranged in the order of mentioning as shown in FIG. 3A, this step determines whether the data read out in the preceding step 72 is timing data or not. If the read-out data is timing data, the flow proceeds to step 77, but if not, the flow branches to step 74. Namely, in this step, the operations of steps 74, 75, 76 and 72 are repeated until the timing data is read out.

Step 74: If the read-out data is velocity data, a timing modification value (or deviation amount) corresponding to the velocity data is determined in accordance with the conversion characteristic of FIG. 5.

Step 75: A value obtained by subtracting the timing modification value (deviation amount) determined in the preceding step 74 from a predetermined value is stored into a count buffer. The predetermined value must not be smaller than the maximum value of positive deviation amounts.

Step 76: Event information and the value stored in the counter buffer COUNT are written into an event buffer. Here, the event information is comprised of note number and velocity data.

Step 77: The timing data read out in step 72 is written into the timing counter TIME.

Step 78. The timing counter TIME is decremented by one.

Step 79: A determination is made as to whether there is any event in the event buffer for which count value is "0". If there is such an event in the event buffer (YES), the flow proceeds to next step 7A, but if not, the flow jumps to step 7C.

Step 7A: The event information is read out from the event buffer to perform a tone generation process.

Step 7B: The event information read out in the preceding step 7A is erased from the event buffer.

Step 7C: The count value for every event in the event buffer is decremented by one, and the flow returns.

Next, with reference to FIG. 8, a description will be made on an example of the general operation of the device executed according to the flowchart of the reproduction process of FIG. 7.

Figure 7:
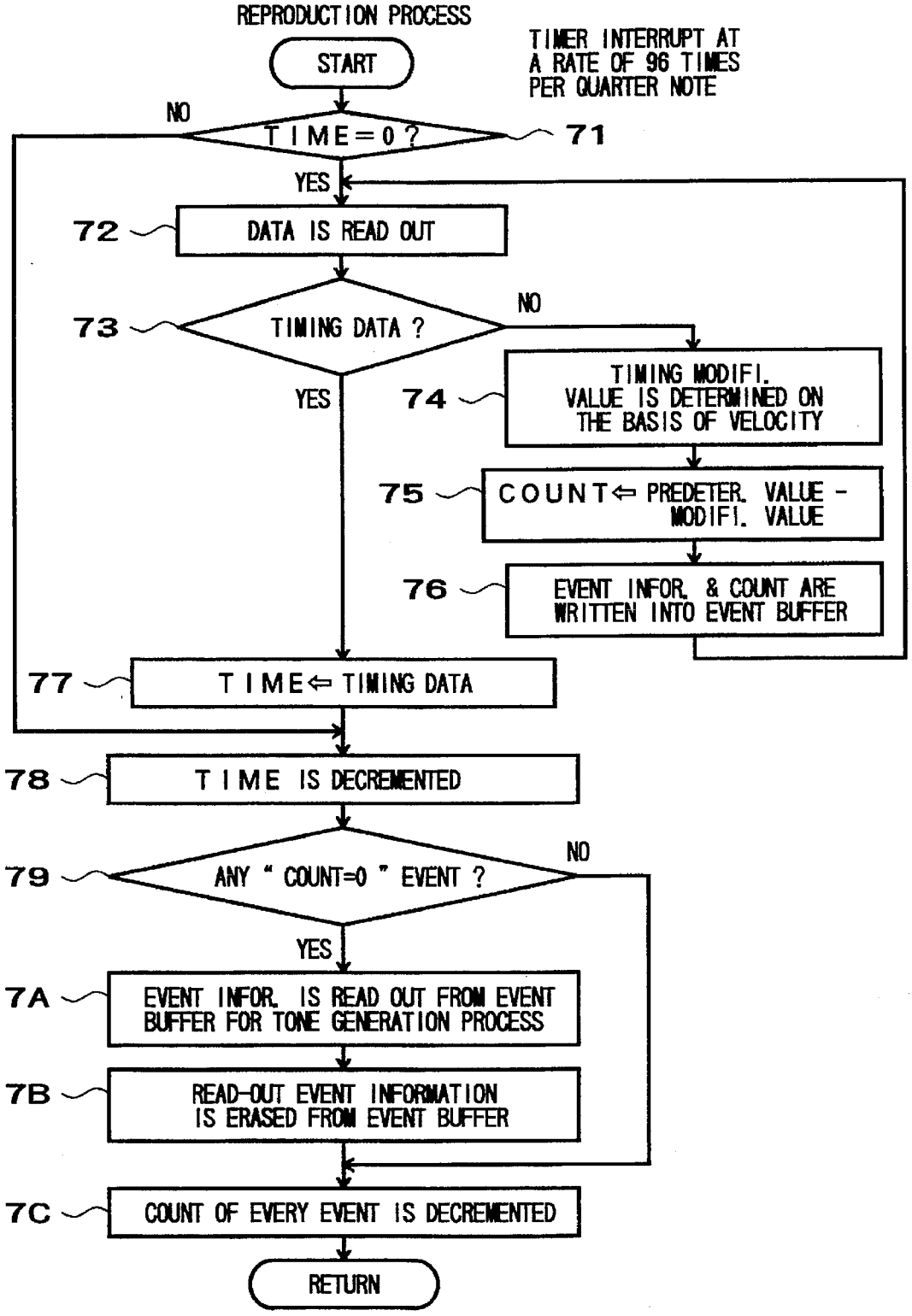
FIG. 7 is a flowchart illustrating an example of a reproduction process performed by the microcomputer.
Figure 8:
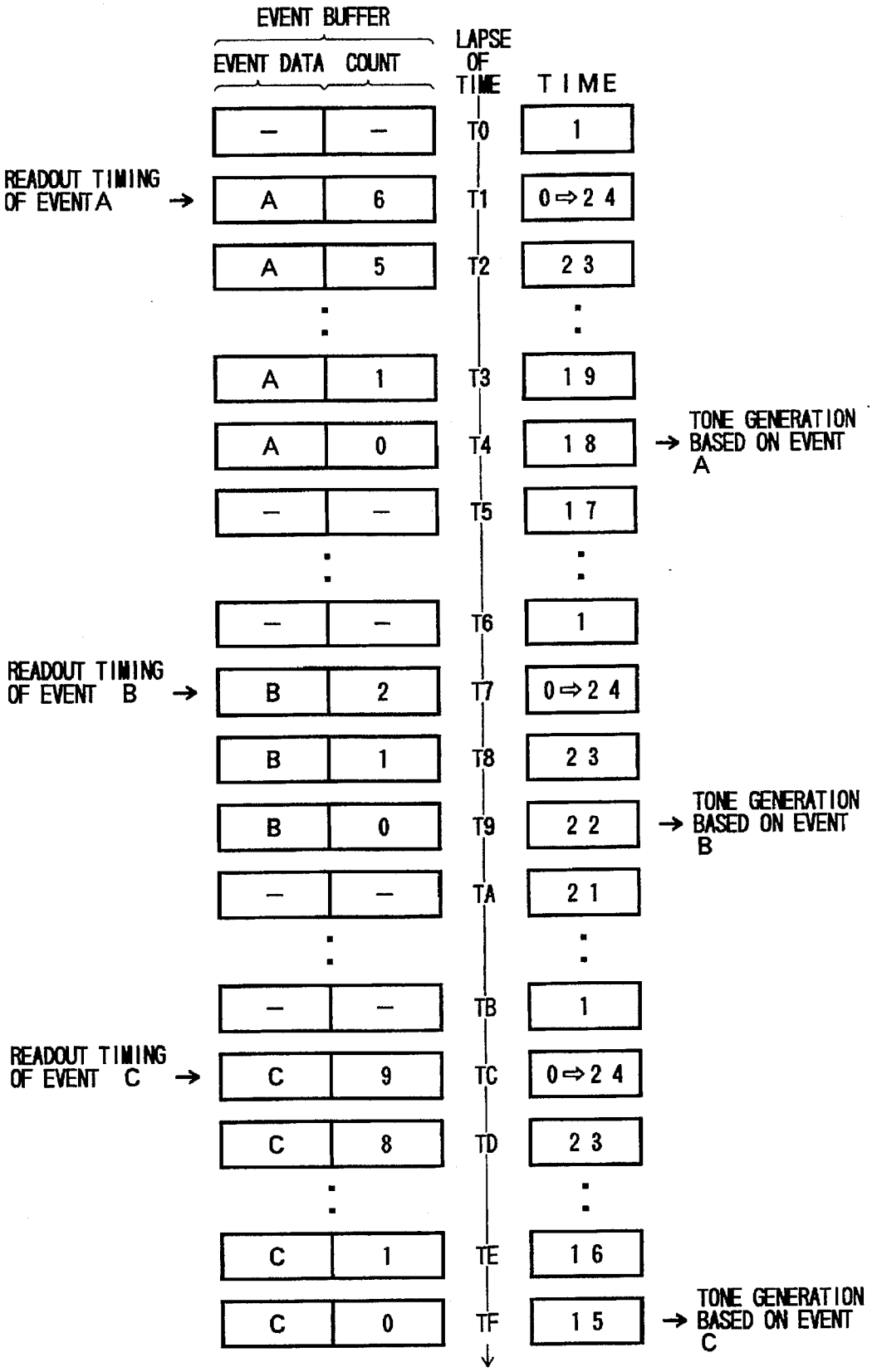
FIG. 8 is a diagram explaining how the contents of the event buffer and timing counter vary with time when the performance data of FIG. 3A are reproduced by the reproduction process of FIG. 7.

FIG. 8 is a diagram explaining how the contents of the event buffer and timing counter vary with time when the performance data such as those of events A, B and C of FIG. 3A are reproduced by the process of FIG. 7.

At first time point T0 of FIG. 8, the time counter TIME is at a count value of "1" and the event buffer contains no event for which count value is "0". Thus, steps 71 and 79 both result in a negative determination, so that the operation of step 78 is performed to decrement the timing counter TIME to "0". However, the operation of step 7C is not performed since no count value is present in the event buffer.

At time point T1, the timing counter is at "0", and hence the determination in step 71 becomes affirmative and the operations of steps 72 to 76 are performed. Because the timing data TDA of event A has already been read out in the preceding reproduction process for event A, the note number NNA of event A is read out in step 72. Because the note number NNA has been read out, a negative determination results in step 73, so that the data readout operation of step 72 is performed again via steps 74 to 76.

In step 72, the velocity data VA (=60) of event A is read out. Because the velocity data has been read out, a "NO" determination results in step 73, and hence the operations of steps 74 to 76 are performed. In step 74, a timing modification value "0" is determined on the basis of the velocity data VA (=60). In step 75, "6" obtained by subtracting the timing modification value "0" from the predetermined value "6" is stored into the count buffer COUNT. Further, step 76 writes the event information of event A (note number NNA and velocity data VA (=60)) and the count value "6" of the count buffer COUNT into the event buffer.

Then, in step 72, the timing data TDB (=24) of event B is read out. At this time, the determination in step 73 becomes affirmative because it is timing data that has been read out, and thus the operation of step 77 is performed. In step 77, the read-out timing data TDB (=24) is stored into the timing counter TIME. After that, the timing counter TIME is decremented to "23" in step 78. Then, the determination in step 79 becomes negative, and consequently the operation of step 7C is performed. In step 7C, the count value of every event in the event buffer is decremented to "5".

Then, at time point T2, because the timing counter TIME is at "23" and the event buffer contains event A for which count value is at "5", steps 71 and 79 both make a negative determination and only the operations of steps 78 and 7C are performed. In step 78, the timing counter TIME is decremented to "22", and the count value for event A is decremented to "4".

In this way, the decrementing of the timing counter TIME in step 78 and the decrementing of the event buffer count value in step 7C are repetitively performed until the event buffer reaches a count value of "0". At time point T4, because the timing counter TIME becomes "18" and the event buffer count value reaches "0", the determination in step 79 becomes affirmative, so that the operations of steps 7A and 7B are performed. In step 7A, the event information (note number NNA and velocity data VA (=60)) is read out for effecting tone generation.

In step 7B, the event information having been read out in the preceding step 7A is erased from the event buffer. Consequently, no count value is present in the event buffer, and hence the operation of step 7C is not performed.

At time point T5, because the timing counter is at a count value of "17" and the event buffer is empty, steps 71 and 79 both make a negative determination, and hence only the operation of step 78 is performed to cause the timing counter TIME to be decremented to "16".

In this way, the decrementing of the timing counter TIME in step 78 is repetitively performed until the timing counter TIME reaches a count value of "0". At time point T7, because the timing counter TIME is at "0", the determination in step 71 becomes affirmative, so that the operations of steps 72 and 76 are performed. The note number NNB of event B is read out in step 72. Because it is a note number that has been read out, a negative determination results in step 73, so that the data readout operation of step 72 is performed again via steps 74 to 76.

In step 72, the velocity data VB (=100) of event B is read out. Because it is velocity data that has been read out, a "NO" determination results in step 73, and hence the operations of steps 74 to 76 are performed. In step 74, a timing modification value "+4" is determined on the basis of the velocity data VB (=100). In step 75, a value "2" obtained by subtracting the timing modification value "+4" from the predetermined value "6" is stored into the count buffer COUNT. Further, step 76 writes the event information of event B (note number NNB and velocity data VB (=100)) and the count value "2" of the count buffer COUNT into the event buffer.

Then, in step 72, the timing data TDC (=24) of event C is read out. At this time, the determination in step 73 becomes affirmative because it is timing data that has been read out in step 72, and thus the operation of step 77 is performed. In step 77, the read-out timing data TDC (=24) is stored into the timing counter TIME. After that, the timing counter TIME is decremented to "23" in step 78. Then, the determination in step 79 becomes negative, and consequently the operation of step 7C is performed. In step 7C, the count value of every event in the event buffer is decremented to "1".

Then, at time point T8, because the timing counter TIME is at "23" and the event buffer contains event B for which count value is at "1", steps 71 and 79 both make a negative determination and only the operations of steps 78 and 7C are performed. In step 78, the timing counter TIME is decremented to "22", and the count value for event B is decremented to "0".

At time point T9, because the timing counter TIME becomes "22" and the event buffer count value reaches "0", the determination in step 71 becomes "NO", so that the operation of step 78 is performed to decrement the timing counter TIME to "21". Then, the determination in step 79 becomes affirmative, and hence the operations of steps 7A, 7B and 7C are performed. In step 7A, the event information (note number NNB and velocity data VB (=100)) of event B is read out from the event buffer for effecting generation of a tone. In step 7B, the event information having been read out in the preceding step 7A is erased from the event buffer. Consequently, no count value is present in the event buffer, and hence the operation of step 7C is not performed.

At time point TA, because the timing counter TIME is at a count value of "21" and the event buffer is empty, steps 71 and 79 both make a negative determination, and hence only the operation of step 78 is performed to cause the timing counter TIME to be decremented to "20".

In this way, the decrementing of the timing counter TIME in step 78 is repetitively performed until the timing counter TIME reaches a count value of "0". At time point TC, because the timing counter TIME is at "0", the determination in step 71 becomes affirmative, so that the operations of steps 72 and 76 are performed. The note number NNC of event C is read out in step 72. Because it is a note number that has been read out, a negative determination results in step 73, so that the data readout operation of step 72 is performed again via steps 74 to 76.

In step 72, the velocity data VC (=30) of event C is read out. Because it is velocity data that has been read out in step 72, a "NO" determination results in step 73, and hence the operations of steps 74 to 76 are performed. In step 74, a timing modification value "–3" is determined on the basis of the velocity data VC (=30). In step 75, a value "9" obtained by subtracting the timing modification value "–3" from the predetermined value "6" is stored into the count buffer COUNT. Further, step 76 writes the event information of event C (note number NNC and velocity data VC (=30)) and the count value "9" of the count buffer COUNT into the event buffer.

Then, in step 72, the timing data TDD (=24) of event D is read out. At this time, the determination in step 73 becomes affirmative because it is timing data that has been read out in step 72, and thus the operation of step 77 is performed. In step 77, the read-out timing data TDD is stored into the timing counter TIME. After that, the timing counter TIME is decremented to "23" in step 78. Then, the determination in step 79 becomes negative, and consequently the operation of step 7C is performed. In step 7C, the count value of every event in the event buffer is decremented to "8".

Then, at time point TD, because the timing counter TIME is at "23" and the event buffer contains event B for which count value is at "8", steps 71 and 79 both make a negative determination and only the operations of steps 78 and 7C are performed. In step 78, the timing counter TIME is decremented to "22", and the count value for event B is decremented to "7".

In this way, the decrementing of the timing counter TIME in step 78 and the decrementing of the event buffer count value in step 7C are repetitively performed until the event buffer reaches a count value of "0". Subsequently, at time point TF, because the timing counter TIME becomes "15" and the event buffer count value reaches "0", the determination in step 79 becomes affirmative, so that the operations of steps 78, 7A and 7B are performed.

In step 78, the timing counter TIME is decremented to "14". In step 7A, the event information (note number NNC and velocity data VC (=30)) of event C is read out from the event buffer for effecting generation of a tone. In step 7B, the event information having been read out in the preceding step 7A is erased from the event buffer. Consequently, no count value is present in the event buffer, and hence the operation of step 7C is not performed.

After that, the decrementing of the timing counter TIME is repetitively performed until next time when the counter TIME reaches a count value of "0".

In the above-mentioned manner, the performance data of FIG. 3A are reproduced for tone generation after the timing data have been modified in accordance with the corresponding velocities.

The embodiment has been described above in connection with a case where the timing data are variably controlled to modify on the basis of the conversion characteristic of FIG. 5. However, various other conversion characteristics such as shown in FIGS. 9A to 9H may also be used. The individual conversion characteristics of FIGS. 9A to 9H will be described below.

Figure 9A:
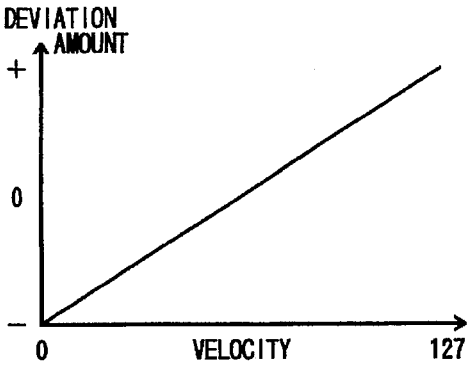
FIGS. 9A to 9H are graphs showing other examples of the timing data conversion characteristic employed in the embodiment, in each of which the horizontal axis represents velocity and the vertical axis represents deviation amount of the timing data.

The conversion characteristic of FIG. 9A, which corresponds to that of FIG. 5, is one that allows the deviation amount to vary linearly in proportion to velocity. Namely, according to the conversion characteristic FIG. 9A, when the velocity is higher than a reference velocity, the deviation amount assumes a positive (+) value and the value of timing data decreases by a value corresponding to the deviation amount, so that tone will be generated at timing slightly earlier than predetermined timing, thus resulting in a relatively "hasty" or "forward-plunging" performance. Conversely, when the velocity is lower than the predetermined reference velocity, the deviation amount assumes a negative (–) value and the value of timing data increases by a value corresponding to the deviation amount, so that a tone will be generated at timing slightly later than predetermined performance timing, thus resulting in a relatively "lagging" or "dull" performance.

Figure 9B:
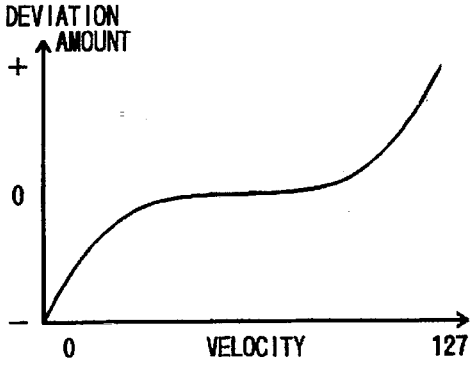

The conversion characteristic of FIG. 9B is one that allows the deviation amount to vary non-linearly on the basis of velocity. Namely, according to the conversion characteristic FIG. 9B, the deviation amount assumes a positive (+) value when the velocity is higher a reference velocity, but assumes a negative (–) value when the velocity is lower than the reference velocity; the variation curve of the deviation amount is very gentle in the reference value region and steep at the opposite end portions of the region.

Figure 9C:
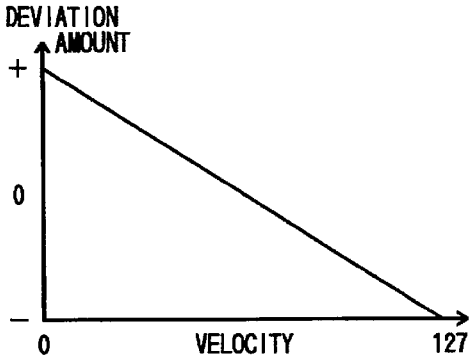

The conversion characteristic of FIG. 9C is one that allows the deviation amount to vary linearly in inverse proportion to velocity, i.e., in the opposite direction to the case of FIG. 9A. Namely, with the conversion characteristic FIG. 9C, the deviation amount assumes a negative (–) value when the velocity is higher than a reference velocity, but assumes a positive (+) value when the velocity is lower than the reference velocity.

Figure 9D:
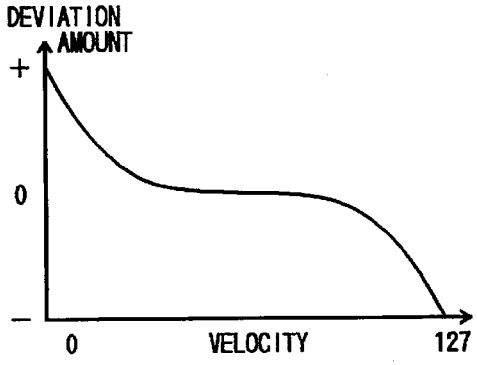

The conversion characteristic of FIG. 9D is one that allows the deviation amount to vary non-linearly in the opposite direction to the case of FIG. 9B. Namely, according to the conversion characteristic FIG. 9D, the deviation amount assumes a negative (–) value when the velocity is higher than a reference velocity, but assumes a positive (+)

value when the velocity is lower than the reference velocity; the variation curve of the deviation amount is very gentle in the reference value region and steep at the opposite end portions of the region.

Figure 9E:
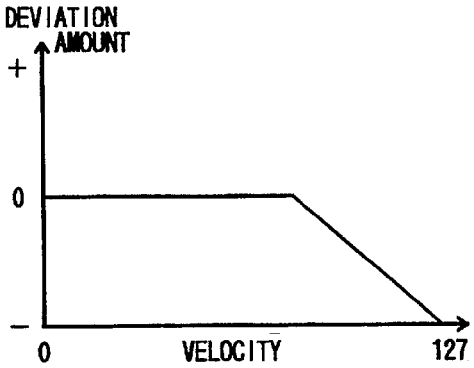

The conversion characteristic of FIG. 9E is one that allows the deviation amount to remain unvaried when the velocity is lower than a predetermined value but vary linearly to negative value once the velocity exceeds the predetermined value.

Figure 9F:
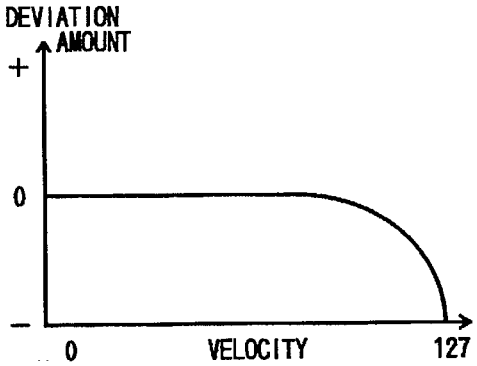

The conversion characteristic of FIG. 9F is one that allows the deviation amount to remain unvaried when the velocity is lower than a predetermined value but vary non-linearly to negative value once the velocity exceeds the predetermined value.

Figure 9G:
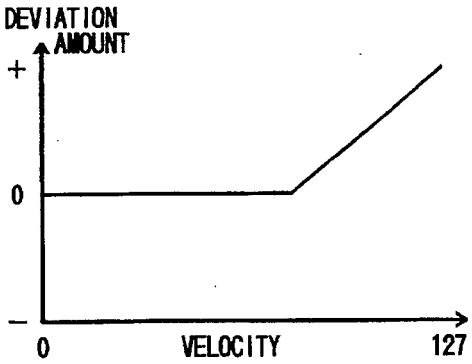

The conversion characteristic of FIG. 9G is one that allows the deviation amount to remain unvaried when the velocity is lower than a predetermined value but vary linearly to positive value once the velocity exceeds the predetermined value.

Figure 9H:
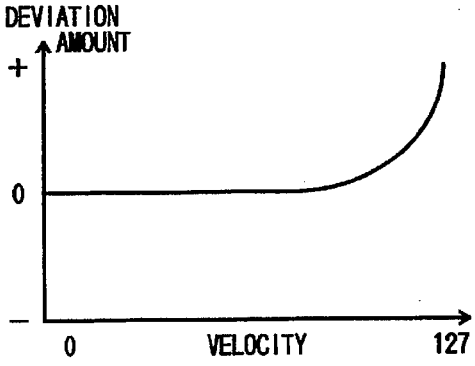

The conversion characteristic of FIG. 9H is one that allows the deviation amount to remain unvaried when the velocity is lower than a predetermined value but vary non-linearly to positive value once the velocity exceeds the predetermined value.

Although the preferred embodiment of the invention has so far been described as applied to an electronic musical instrument having an automatic performance device, the present invention is of course also applicable to other types of electronic musical instrument where a sequencer for performing automatic performance processing and a tone source module comprised of depressed key detecting and tone source circuits are provided separately from each other and data are exchanged between the modules in accordance with the well-known MIDI standards.

Further, the present invention may be applied to automatic rhythm performance and automatic accompaniment performance.

Furthermore, although the preferred embodiment has been described in connection with a case where tone generation timing is modified on the basis of velocity, the tone generation timing thus modified may be additionally modified in a random manner. This additional modification will achieve more natural musical "fluctuation". The tone generation timing may also be modified on the basis of any other factor than the velocity of a tone to be timing-modified, such as the velocity of either or both of tones preceding and succeeding that tone, or information for setting or controlling the duration and/or pitch etc. of that tone.

Moreover, the velocity-based timing modification may be performed in addition to the conventional deviation-pattern-based timing modification. In this manner, a specific timing deviation based on the pattern can be even more delicately or finely varied by velocity, and thus variations of superior musical quality can be provided.

Furthermore, although the preferred embodiment has been described in connection with a case where the timing deviation is given in recording and reproduction processes, an alternative arrangement of the present invention may be such that performance data originally stored with no timing deviation is rerecorded after having been imparted timing deviation.

What is more, although the preferred embodiment has been described as imparting timing deviation in such units based on minimum resolution of performance data (i.e., timer interrupt interval), finer timing deviation may be imparted.

Furthermore, the degree and presence or absence of timing deviation may be variably selected depending on which of different musical instruments the tone is provided from. This is particularly useful in an automatic rhythm performance.

Data indicative of the degree and presence or absence of the timing deviation may be contained in performance data so that the degree and presence or absence of the timing deviation vary in accordance with the progress of a performance.

In another alternative arrangement, a plurality of performance patterns may be stored and the degree and presence or absence of timing deviation may be set for each of the performance patterns.

Moreover, it should be appreciated that the velocity and the deviation amount may be in any other relation than shown in FIGS. 5 and 9A to 9H. It is also possible to provide the tone generation timing deviation on the basis of a relation between the velocity and the deviation amount that is found in performance data derived from a famous player's actual performance.

Although the preferred embodiment has been described as determining a timing modification value on the basis of velocity, the timing modification value may also be varied in real time in response to the output of the foot pedal 32. Alternatively, the timing modification value may be varied in real time by means of any other operating member such as a volume slider.

What is more, although the embodiment has been described in relation to the "event system" where, only for timing when a tone generation event exists, performance data is stored with pitch information and tone generation control information, the present invention may of course also be applicable to the "full writing system" where pitch information and tone generation control information are sequentially stored at every address corresponding to a tempo clock pulse.

The application of the present invention should not be understood as limited to the "real time recording" where event occurrence timing is directly recorded in real time; the present invention may also be applicable to the "step recording system" where timing (note duration) and event are recorded in response to designating operation by switch operator or the like. However, what is recorded in this step recording system is not actual timing of event occurrence but timing of the designation operation.

Furthermore, according to the present invention, the timing modification value may be determined by performing predetermined arithmetic operation rather than by referring to a look-up table.

With the foregoing novel features, the present invention achieves fine variation in generation timing of individual tones, thus imparting a variety of musical expressions to an automatic performance as in a live performance.

What is claimed is:

1. An automatic performance device comprising:

storage means for storing performance data;

event generation means for generating event data in response to a performance event, wherein the event data contains predetermined data;

timing data providing means, responsive to generation of the event data, for providing timing data indicative of a reproduction timing of the performance event;

timing modification means for modifying said timing data so as to vary said reproduction timing based upon a value of the predetermined data contained in said event data generated by said event generation means;

recording means for causing the event data generated by said event generation means to be recorded into said storage means along with the timing data modified by said timing modification means, as the performance data; and reproduction means for reading out said event data and timing data from said storage means so as to reproduce the performance event on the basis of the read-out data.

2. An automatic performance device as defined in claim 1, wherein said event data contains velocity data for controlling intensity of a tone to be performed, and the velocity data is used as said control information.

3. An automatic performance device as defined in claim 1, wherein said timing modification means includes a table indicative of a relation between a value of said control information and a timing modification mount and modifies the timing data by referring to said table.

4. An automatic performance device as defined in claim 1, wherein said timing modification means modifies the timing data corresponding to a given event by use of the control information corresponding to the given event.

5. An automatic performance device as defined in claim 1, wherein said timing modification means modifies the timing data corresponding to a given event by use of the control information corresponding to a different event from the given event.

6. An automatic performance device comprising:

storage means for storing performance data;

event generation means for generating event data in response to a performance event, wherein the event data contains predetermined data;

timing data providing means, responsive to generation of the event data, for providing timing data indicative of a reproduction timing of the performance event;

recording means for causing the event data generated by said event generation means to be recorded into said storage means along with the timing data, as the performance data; and reproduction means for reading out said event data and timing data from said storage means so as to reproduce the performance event on the basis of the read-out data; and timing modification means for modifying said timing data read out from said storage means based upon a value of the predetermined data contained in said event data generated by said event generation means, said reproduction means reproducing said performance event data on the basis of said event data and said timing data modified by said timing modification means.

7. An automatic performance device as defined in claim 6, wherein said event data contains velocity data for controlling intensity of a tone to be performed, and the velocity data is used as said control information.

8. An automatic performance device as defined in claim 6, wherein said timing modification means includes a table indicative of a relation between a value of said control information and a timing modification amount and modifies the timing data by referring to said table.

9. An automatic performance device as defined in claim 6, wherein said timing modification means modifies the timing data corresponding to a given event by use of the control information corresponding to the given event.

10. An automatic performance device as defined in claim 6, wherein said timing modification means modifies the timing data corresponding to a given event by use of the control information corresponding to a different event from the given event.

11. An automatic performance device comprising:

performance data providing means for providing performance data containing event data indicative of a performance event and timing data indicative of reproduction timing of the performance event, wherein the event data contains predetermined data;

reproduction means for reproducing the performance event on the basis of the event data and timing data provided from said performance data providing means;

first modification means for modifying the reproduction timing of the performance event based upon a value of the predetermined data contained in said event data; and second modification means for further modifying the reproduction timing of the performance event having already been modified by said first modification means.

12. An automatic performance device as defined in claim 11, wherein said second modification means includes a memory storing a modification pattern.

13. An automatic performance device as defined in claim 11, wherein said second modification means includes means for generating a time-varying modification signal.

14. An automatic performance device as defined in claim 11, wherein said second modification means includes means for generating said modification signal that varies in response to operation by a player.

15. An automatic performance device as defined in claim 11, wherein said event data contains velocity data for controlling the intensity of tone to be performed, and the velocity data is used as said control information.

16. An automatic performance device as defined in claim 11, wherein said first modification means includes a table indicative of a relation between a value of said control information and a timing modification mount and modifies the timing data by referring to said table.

* * * * *